US012507769B2

(12) United States Patent
Celant et al.

(10) Patent No.: US 12,507,769 B2
(45) Date of Patent: Dec. 30, 2025

(54) TIMEPIECE COMPONENT PROVIDED WITH A CAP

(71) Applicant: ROLEX SA, Geneva (CH)

(72) Inventors: Benjamin Celant, Geneva (CH); Jean-Baptiste Robin, Annemasse (FR)

(73) Assignee: ROLEX SA, Geneva (CH)

( * ) Notice: Subject to any disclaimer, the term of this patent is extended or adjusted under 35 U.S.C. 154(b) by 854 days.

(21) Appl. No.: 17/401,525

(22) Filed: Aug. 13, 2021

(65) Prior Publication Data

US 2022/0053895 A1 Feb. 24, 2022

(30) Foreign Application Priority Data

Aug. 18, 2020 (EP) ..... 20191465

(51) Int. Cl.
*A44C 5/24* (2006.01)

(52) U.S. Cl.
CPC ..... *A44C 5/24* (2013.01)

(58) Field of Classification Search
CPC ..... A44C 5/24; A44C 5/04; G04B 45/009
See application file for complete search history.

(56) References Cited

U.S. PATENT DOCUMENTS 2,446,068 A 7/1948 Valcourt
2,636,338 A * 4/1953 Dinstman ..... G04B 37/0025 368/286
3,445,900 A 5/1969 Currat
3,609,962 A 10/1971 Rieth
4,293,942 A 10/1981 Baumgartner
(Continued)

FOREIGN PATENT DOCUMENTS

CH 1134961 A4 3/1964
CN 1350818 A 5/2002
(Continued)

OTHER PUBLICATIONS

Office Action dated Jun. 27, 2022 in co-pending U.S. Appl. No. 17/401,540, with PTO892; without returned SB08 (total 12 pages) (Note: ref.A cited on the PTO892 is not listed in this IDS since it is the publication of this application).
(Continued)

*Primary Examiner* — Jason W San
*Assistant Examiner* — Michael S Lee
(74) *Attorney, Agent, or Firm* — Seckel IP, PLLC

(57) ABSTRACT

A timepiece component having a first part and a removable cap which can adopt a fastening configuration and a free configuration. The first part comprises at least one first latching member and a movable lock. The cap comprises at least one first assembly member designed to cooperate with the first latching member of the first part, and a second assembly member designed to cooperate with the movable lock. In the fastening configuration, the first latching member of the first part and the first assembly member of the cap are in engagement. The movable lock is in engagement with the second assembly member of the cap. The cap is fastened in a locked manner to the first part. In the free configuration, the movable lock occupies an open position in which it releases the second assembly member of the cap and allows the cap to be separated from the first part.

23 Claims, 5 Drawing Sheets

(56) References Cited

U.S. PATENT DOCUMENTS

| | | | | |
|---|---|---|---|---|
| 4,543,692 | A | 10/1985 | Ode et al. | |
| 4,821,532 | A | 4/1989 | Jaques et al. | |
| 5,787,554 | A | 8/1998 | Hashimoto | |
| 6,308,382 | B1 | 10/2001 | Takahashi et al. | |
| 6,442,970 | B1 | 9/2002 | Dangelmayer et al. | |
| 6,588,069 | B2 | 7/2003 | Deriaz et al. | |
| 2002/0078535 | A1 | 6/2002 | Deriaz et al. | |
| 2004/0168285 | A1 | 9/2004 | Chan | |
| 2009/0238045 | A1 | 9/2009 | Felton | |
| 2015/0047156 | A1 | 2/2015 | Ninomiya | |
| 2016/0286909 | A1 | 10/2016 | Izzo | |
| 2018/0168293 | A1 | 6/2018 | Leiggener | |
| 2021/0386161 | A1* | 12/2021 | Ziegenbein | G04G 17/083 |
| 2022/0053891 | A1 | 2/2022 | Celant et al. | |
| 2024/0126211 | A1* | 4/2024 | Peng | G04B 45/0092 |

FOREIGN PATENT DOCUMENTS

| | | | |
|---|---|---|---|
| CN | 1524472 | A | 9/2004 |
| CN | 107242649 | A | 10/2017 |
| CN | 108201202 | A | 6/2018 |
| DE | 10008993 | A1 | 1/2001 |
| GB | 2037029 | A | 7/1980 |
| GB | 2132680 | A | 7/1984 |
| JP | S55-82980 | A | 6/1980 |
| JP | S59-103624 | U | 7/1984 |
| JP | H10-113206 | A | 5/1998 |
| JP | H11-334489 | A | 12/1999 |
| JP | 3065102 | U | 1/2000 |
| JP | 2000-175851 | A | 6/2000 |
| JP | 2002191415 | A | 7/2002 |
| JP | 2016-116592 | A | 6/2016 |

OTHER PUBLICATIONS

EP Office Action dated Dec. 14, 2023 in counterpart application No. EP 20191465.2; with English machine translation (total 12 pages).

European Search Report and Written Opinion dated Jan. 20, 2021 in priority application No. EP20191466.0 of co-pending U.S. Appl. No. 17/401,540; with English machine translation (total 15 pages).

Japanese Office Action dated Feb. 18, 2025 in counterpart application No. JP 2021-132622; with English machine translation (total 10 pages).

CN Office Action and Search Report dated Aug. 1, 2025 in counterpart application No. CN 202110950833.4; with English machine translation (total 17 pages) (note: JPH10-113206, D1 cited in the CN Office Action and U.S. Pat. No. 3,609,962, D5 in the CN Search Report, are not listed in this IDS since they are already of record).

Japanese Office Action dated Apr. 15, 2025 in application No. JP 2021-132624, counterpart of co-pending U.S. Appl. No. 17/401,540, now U.S. Pat. No. 11,638,467; with English machine translation (total 12 pages) (note: U.S. Appl. No. 17/401,540, JP2002-191415, U.S. Pat. No. 6,442,970, D1-D3 cited in the JP Office Action are not listed in this IDS since they are already of record; JP2016-116592, D6 cited in the JP Office Action, is not listed on this IDS form since it is listed on another IDS form filed concurrently).

CN Office Action and Search Report dated Sep. 8, 2025 in application No. CN 202110948489.5, counterpart of co-pending U.S. Appl. No. 17/401,540, now U.S. Pat. No. 11,638,467; with English machine translation (total 23 pages) (note: D1-D2 cited in the CN Office Action and D1-D4 in the CN Search Report are not listed in this IDS since they are already of record).

European Search Report and Written Opinion dated Jan. 20, 2021 in priority application No. EP20191465.2; with English machine translation (total 14 pages).

* cited by examiner

TIMEPIECE COMPONENT PROVIDED WITH A CAP

This application claims priority of European patent application No. EP20191465.2 filed Aug. 18, 2020, the content of which is hereby incorporated by reference herein in its entirety.

INTRODUCTION

The present invention relates to a timepiece component provided with at least one cap. The invention also relates to a timepiece comprising such a timepiece component. The invention also relates to a method for manufacturing such a timepiece component.

BACKGROUND ART

In order to improve scratch resistance, and/or change the appearance of a timepiece component, in particular of an external timepiece component such as a bracelet clasp, a bracelet link or a middle, it is known to fasten a cap to a vulnerable and/or visible part of said timepiece component. An ideal cap of this kind should meet the following requirements:

- it should permit assembly, with a timepiece component, that is simple and free from any risk of damage;
- it should be robust in order to withstand external loads such as impacts and scratches;
- it should be fastened in a reliable manner so as to avoid unintended disassembly;
- it should be esthetically appealing.

Depending on the nature, in particular the material of the cap and of the component, the existing solutions such as brazing do not satisfactorily meet all of these requirements. Hence, the invention has the general object of proposing a novel solution for a timepiece component provided with a cap, which improves on the existing solutions, by best meeting the above requirements.

More specifically, the invention has the object of proposing a solution for a timepiece component provided with a cap that is robust, reliable, simple to implement, and that can be esthetically appealing.

SUMMARY OF THE INVENTION

To that end, the invention relates to a timepiece component having a first part and a removable cap, the timepiece component being able to adopt a fastening configuration in which the removable cap is fastened to the first part, and a free configuration in which the cap is separated from the first part, the first part comprising at least a first latching member (or hooking member) and a movable lock, and the cap comprising at least a first assembly member, intended to cooperate with the first latching member of the first part, and a second assembly member, intended to cooperate with the movable lock of the first part, such that, in the fastening configuration of the timepiece component, the first latching member of the first part and the first assembly member of the cap are in engagement, and the movable lock occupies a closed position in which it is in engagement with the second assembly member of the cap, in such a way that the cap is fastened in a locked manner on the first part, and such that, in the free configuration, the movable lock occupies an open position in which it releases the second assembly member of the cap, allowing the cap to be separated from the first part of the timepiece component.

The invention is specifically defined by the claims.

BRIEF DESCRIPTION OF THE DRAWINGS

These objects, features and advantages of the present invention will be disclosed in detail in the following non-limiting description of a particular embodiment given with reference to the appended figures, in which.

DETAILED DESCRIPTION OF PARTICULAR EMBODIMENTS

To simplify the description of the embodiment, the present document will use, by convention, the terms "longitudinal direction" for the direction along the length of a clasp or a strand of a bracelet, and "transverse direction" for the direction perpendicular to the length of a clasp or a strand of a bracelet, in the plane of a clasp (more specifically the plane of a blade or of a cover of the clasp), considering in particular the closed configuration of the clasp. The vertical direction is the direction perpendicular to the two first directions, oriented perpendicular to the plane of the clasp (more specifically of a blade or of a cover of the clasp). The adjectives "upper" and "lower" will be used in relation to this vertical direction. By extension, these directions and definitions will apply to a clasp cover, considering the position that this would have within a clasp.

Figure 1:
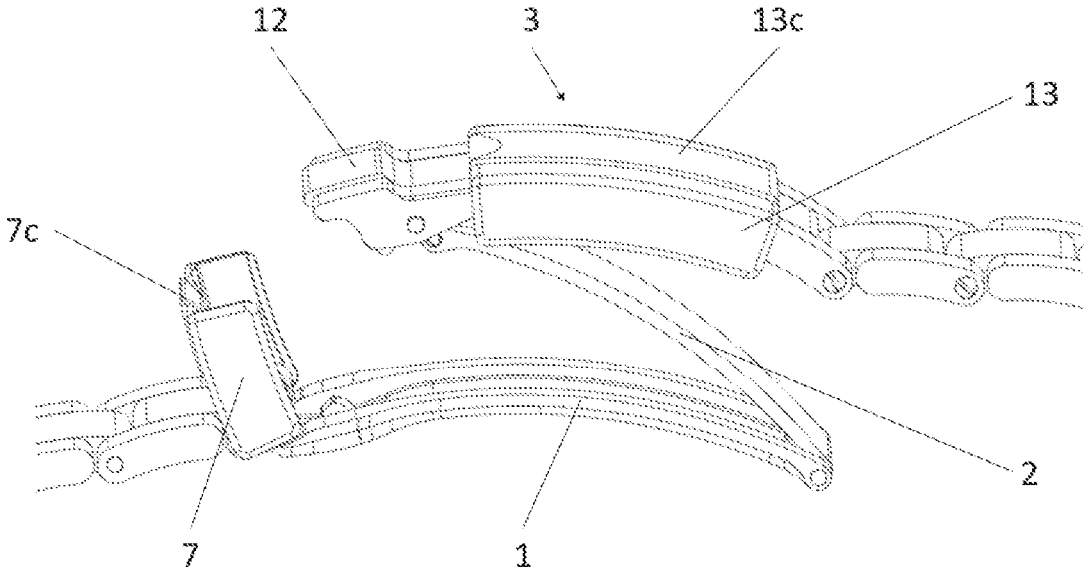
FIG. 1 depicts a perspective view of an open clasp comprising a cover provided with a cap according to one embodiment of the invention.

FIG. 1 depicts a clasp for a bracelet according to one embodiment of the invention. This clasp comprises two blades 1, 2 that are articulated about an axis at one of their ends. The free end of the blade 1 is as one with a first articulation pin that serves for articulating a complementary cover 7, 7*c*, and with a second articulation pin that serves for articulating an end of one of the strands of the bracelet. The free end of the blade 2 is as one with a movable structure 3 that is articulated so as to be able to move in rotation. Thus, the clasp can adopt an open position, as shown in FIG. 1, where it is partially deployed, and a closed position in which the second blade 2 and the structure 3 are folded together and locked onto the first blade 1. The end of a first bracelet strand is fastened to the second end of the first blade 1 and the end of a second bracelet strand is fastened to the free end of the movable structure 3.

The invention relates more specifically to a cover of the clasp. This cover is principally integrated into the structure 3 of the clasp. The cover comprises a first part 13 which has a vertical cross section in the shape of an inverted U, having an upper face that is visible to a user, and two lateral walls that are substantially perpendicular to the upper face and are intended to laterally cover all of the clasp and its mechanism so as to hide it when in the closed position and ensure the esthetic appearance of the solution. The cover further comprises a removable cap 13*c* (or overlay). Thus, the cap is able to adopt a fastening configuration in which the removable cap 13*c* is fastened to the first part 13, and a free configuration in which the cap 13*c* is separated from the first part 13.

In addition, the clasp comprises a complementary cover 7, 7*c* that is arranged on the first blade 1 and is intended to fold down into a position of closing the cover, to be positioned in continuity with the cover arranged on the movable structure 3, and to also cover a locking lever 12, and thus form a single cover for the clasp that includes a safety element. This complementary cover part has a structure similar to that described hereinabove, that is to say a first part 7 that cooperates with a removable cap 7*c*. It can be assembled according to the same concept as the invention, or differently. It will not be described in greater detail hereinbelow.

The upper surface of the first part 13 of the cover has a planar orthogonal projection that is essentially rectangular in shape. The cap 13*c* takes the form of an element that is substantially planar and elongate which extends over the entire length of the upper surface of the cover and over a portion of the width of the upper surface of the cover, for example over a portion of the width of the upper surface of the cover between 20% and 100%, even between 30% and 90%, even between 45% and 55%. It may or may not be positioned centrally on the cover. Preferably, in the fastening configuration, the cap 13*c* is arranged in a portion that is set back from the first part 13, in the thickness of the upper surface of the first part of the cover, in such a way that it covers this second, set-back portion and occupies the volume freed up by this set-back portion. For example, the upper surface of the cap is thus continuous with the upper surface of the first part, forming an upper surface of the cover that is continuous overall. Alternatively, the upper surface of the cap is set back from or protrudes from the upper surface of the first part.

Figure 2:
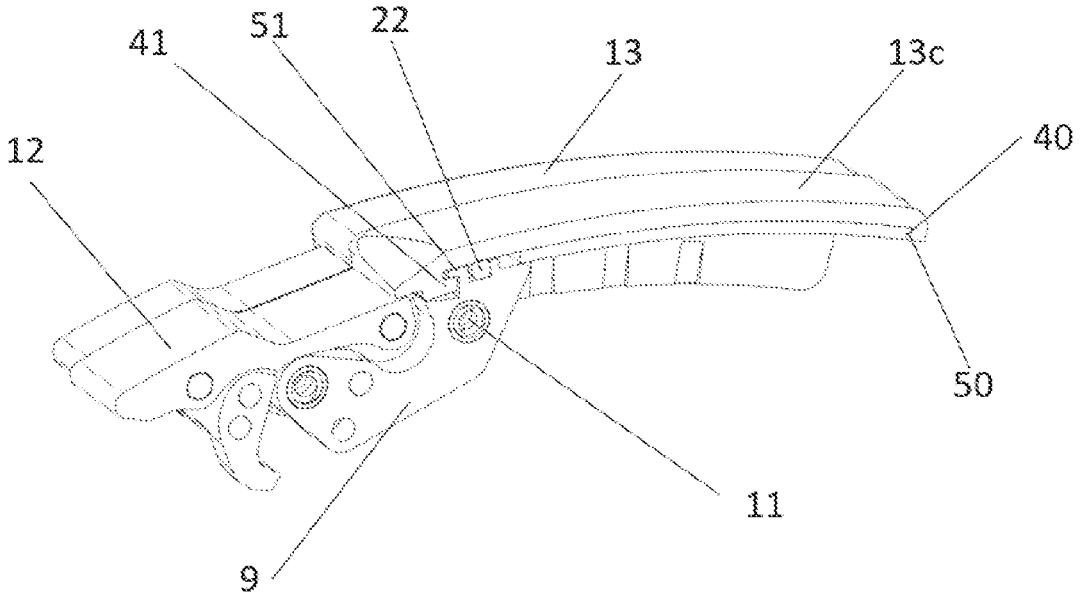
FIG. 2 depicts a partial perspective section view of the cover of the clasp comprising a cap in the fastening configuration according to the embodiment of the invention.
Figure 3:
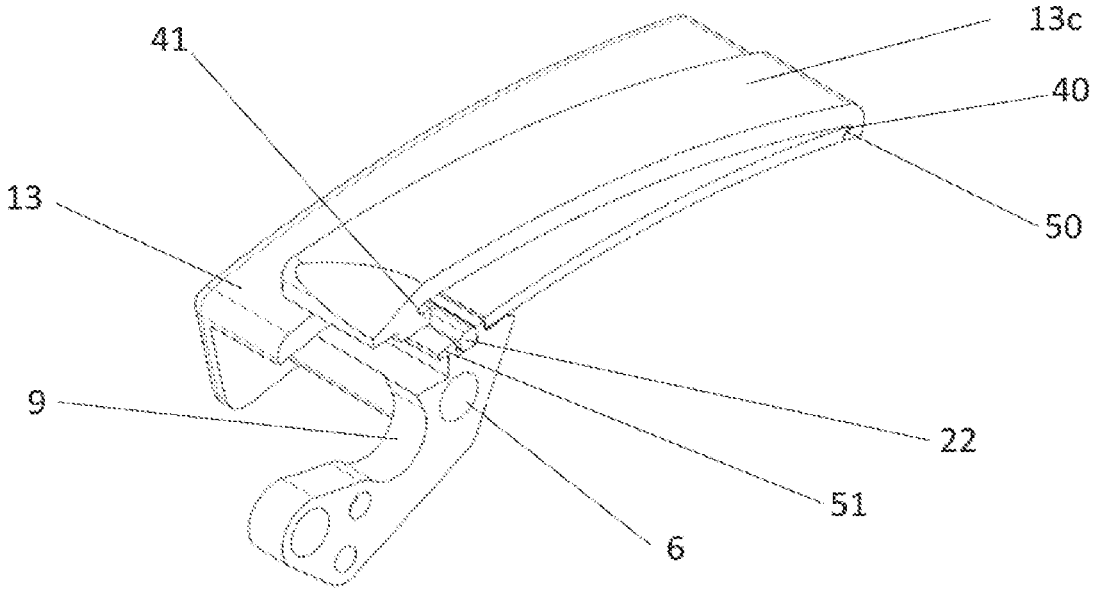
FIG. 3 depicts a partial perspective view in a fastening configuration of the cover of the clasp comprising a cap according to the embodiment of the invention.

FIG. 2 depicts a view in section along a vertical longitudinal median plane of the cover according to the embodiment. FIG. 3 depicts an exploded view without a locking lever 12. These figures make it possible to visualize the device for fastening the cap 13*c* on the first part of the cover. The cap 13*c* comprises at least a first assembly member 40 and a second assembly member 41 that are arranged respectively at its two opposite distal ends, on that side of the surface of the cap 13*c* that is intended to be oriented towards the first part 13 of the cover, that is to say the lower surface of the cap according to the chosen convention. In addition, the first part 13 of the cover comprises at least a first latching member 50 and a movable lock 9. In the fastening configuration, depicted in FIG. 2, the first assembly member 40 of the cap 13*c* cooperates with the first latching member 50 of the first part 13 and the second assembly member 41 of the cap 13*c* cooperates with the movable lock 9 of the first part 13, in particular a second latching member 51 (second hooking member) that is as one with the lock 9. Thus, in the fastening configuration of the cover, the first latching member 50 of the first part 13 and the first assembly member 40 of the cap 13*c* are in engagement. In the fastening configuration of the cover, the second latching member 51 of the first part 13 and the second assembly member 41 of the cap 13*c* are also in engagement.

Advantageously, the cap 13*c* takes the form of a one-piece element. It may additionally be advantageously made of a material different than the material of the first part 13, in particular a material which has impact- and scratch-resistant mechanical properties, and/or which can be esthetically very appealing, for example a ceramic, cermet, glass, sapphire, mother-of-pearl, amber or natural or reconstituted stone. As a variant, it may be made of metal and/or of the same material as that of the first part 13.

Preferably, the first part 13 of the cover is made of a metal alloy, for example stainless steel, gold, platinum, bronze or titanium.

Figure 9:
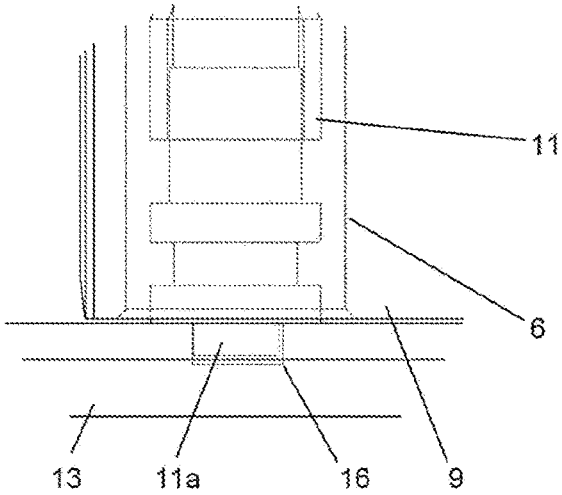
FIG. 9 depicts a detail view of FIG. 8, at a bar of the clasp in the fastening configuration.

The movable lock 9 may occupy a closed position and an open position, according to operation which will be set out below. It comprises a latching member 51 that is designed to cooperate with the second assembly member 41 of the cap 13*c*. The first part 13 preferably comprises a first opening 16 arranged in each of its lateral walls, in the form of a cutout in the inner surface of these lateral walls, and the movable lock 9 comprises a lock opening 6, said first opening 16 and lock opening 6 being arranged in such a way that they come substantially to face one another when the lock 9 is in the closed position. Thus, a retractable bar 11 is able to cooperate with said first opening 16 and lock opening 6 when the movable lock 9 is in the closed position, as depicted in FIG. 9, so as to lock this closed position of the movable lock 9 and thus lock the fastening configuration of the cover.

The cover further comprises a play compensating element 22 interposed between the lock 9 and the cap 13*c*, this element being made of a flexible and/or deformable material that is designed to be compressed between the cap 13*c* and the lock 9 when the lock 9 is in its first, closed position and/or against which the movable lock 9 comes to abut in its closed position. This play compensating element makes it possible to reduce the freedom of movement arising from manufacturing tolerances.

In the preferred embodiment, the two assembly members 40, 41 of the cap have a hook-shaped cross section extending over the entire width of the cover and forming notches that cooperate with complementary shapes of at least one latching member 50 of the first part 13 and of at least one latching member 51 of the lock 9.

Figure 4:
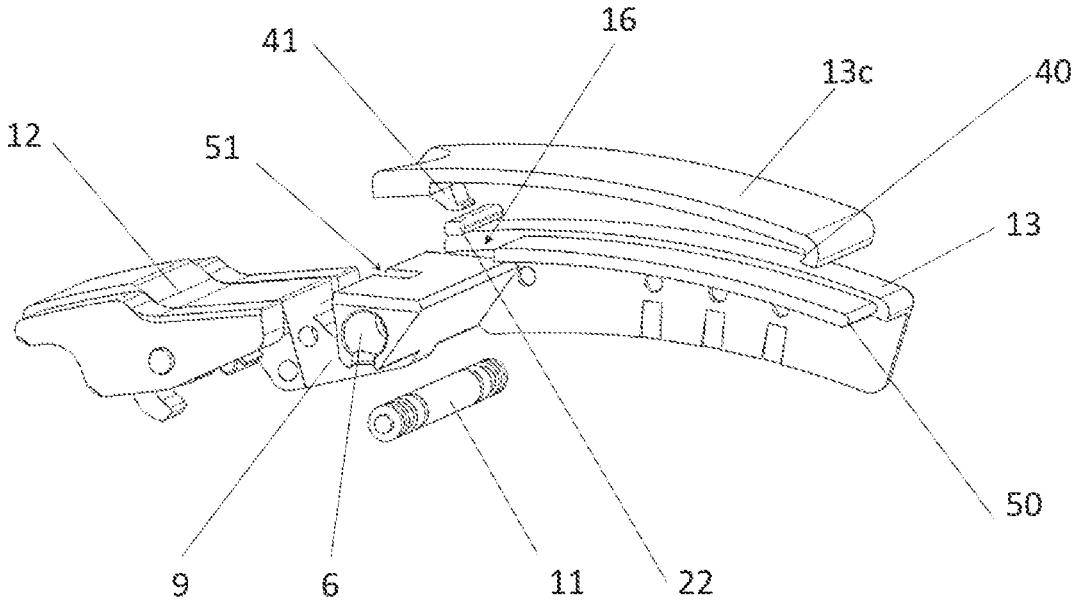
FIG. 4 depicts an exploded partial perspective view of the cover of the clasp comprising a cap according to a variant of the embodiment of the invention.

FIG. 4 depicts an exploded view of one variant of an embodiment. The geometry of the second latching member 51, which is intended to cooperate with the second assembly member 41, which is itself limited to a portion of the width of the cap 13*c*, is in the form of a notch in the lock 9.

Naturally, the invention is not limited to the examples and embodiment variants described. In particular, it is possible to have any other number of latching members (hooking members) on the first part and assembly members on the cap. These members may moreover be in another form, and at a different position. For example, these members may take the form of a hook and/or a notch and/or a cutaway and/or a groove and/or a lug and/or a beam. Similarly, the cap could adopt any other shape, and any other position on the first part, not necessarily centered. It could take on any other geometry. The assembly of the clasp according to the embodiment will now be explained, with reference to FIGS. 5 to 7, in the context of passing from a free configuration to a fastening configuration of the cap 13*c* on the first part 13 of the cover.

Figure 5:
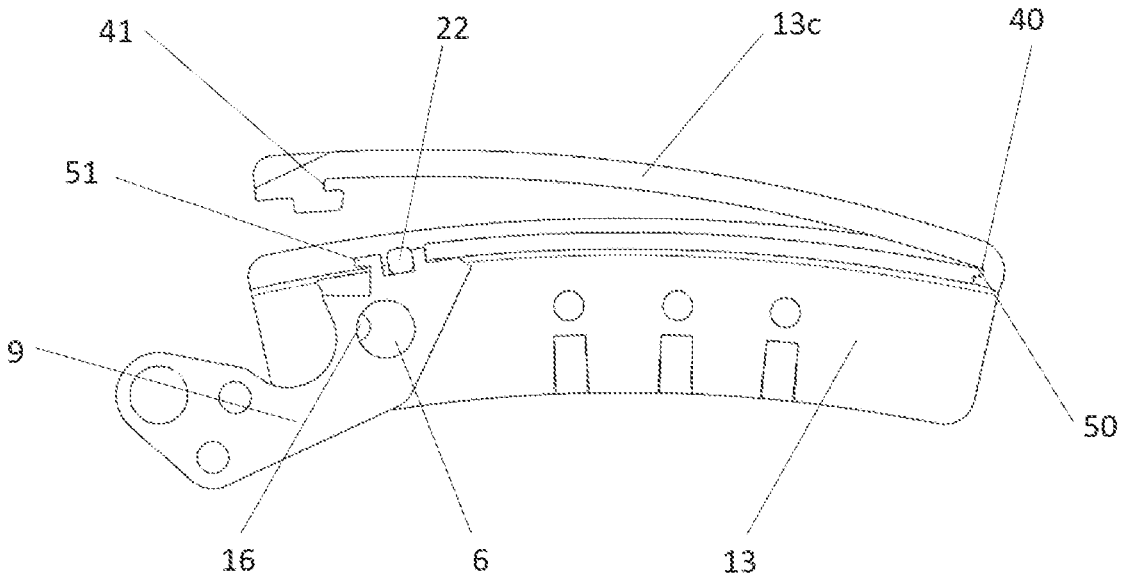
FIG. 5 depicts a side view in section along a median vertical longitudinal plane of the cover of the clasp comprising a cap in the assembly phase according to the embodiment of the invention.
Figure 6:
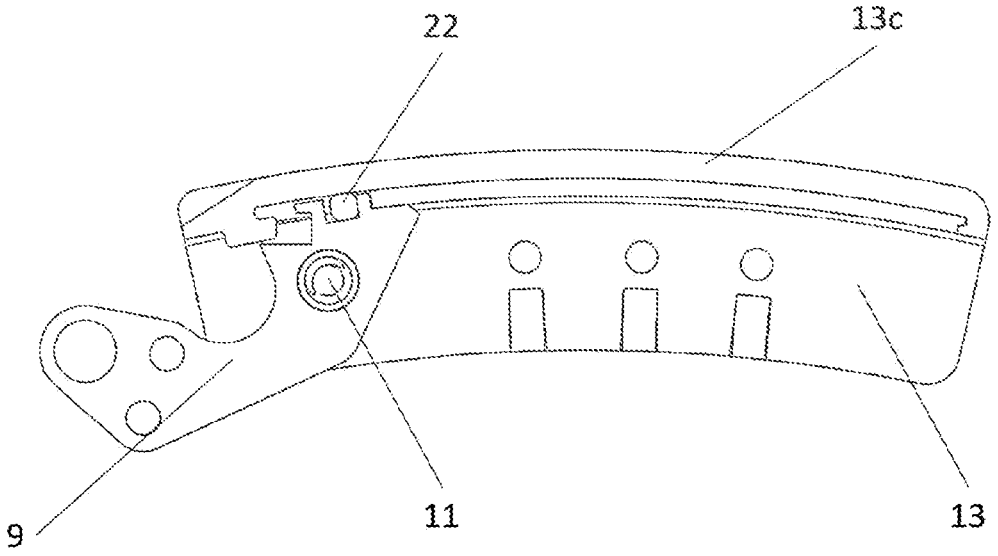
FIG. 6 depicts the same side view in section as that in FIG. 5, but with the cover of the clasp comprising a cap in an intermediate configuration according to the embodiment of the invention.
Figure 10:
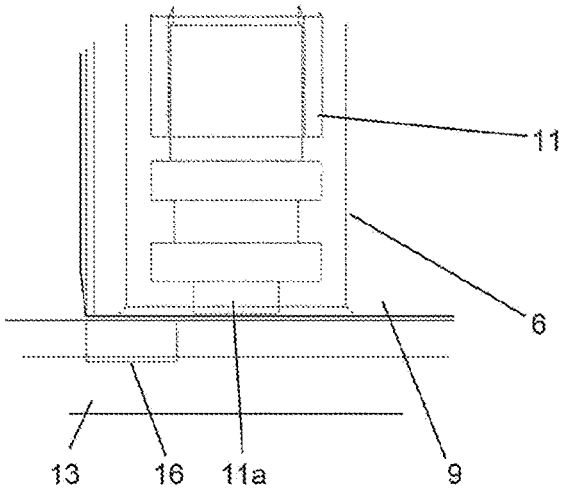
FIG. 10 depicts a detail view of FIG. 8, at a bar of the clasp in the free configuration.

FIG. 5 depicts a first phase of assembly in which the first assembly member 40 of the cap 13*c* is linked to the latching member 50 of the first part 13. The cap 13*c* is then folded down onto the first part 13, by pivoting about an axis formed by the connection between the members 40, 50, until it reaches the intermediate configuration depicted in FIG. 6. The movable lock 9 is in an open position, which is made possible by a clearance cutout provided in the cover. In FIG. 5, the bar 11 by means of which the lock 9 can be locked in the fastening position is not illustrated in order to show the offset between the first opening 16 and the lock opening 6 in the open position. In the open position, the pivots 11 a of the bar 11 are retracted, as illustrated in FIG. 10.

In the intermediate configuration, the cap is in its final position, but is not locked, and hence it can be removed. Indeed, the movable lock 9 is in its open position, in which position it is not in engagement with the second assembly member 41 of the cap 13*c*. The bar 11 inserted into the lock opening 6 is not positioned facing the first openings 16; its pivots 11*a* are retracted as illustrated in FIG. 10.

The lock 9 is then moved into its closed position, in which position its latching member 51 comes to be in engagement with the second assembly member 41 of the cap 13*c*. Thus, the cover reaches its fastening configuration, depicted in FIG. 7, in which the cap 13*c* can no longer be released. As previously mentioned, in this closed position of the lock 9, the lock opening 6 of the lock 9 is substantially aligned with the two corresponding first openings 16 of the first part 13. The pivots 11*a* of the bar 11 can thus fit into these two first openings 16 and maintain the locked position, as illustrated in FIG. 9. The cap 13*c* is thus locked onto the first part of the cover 13.

For example, the lock 9 is therefore mounted so as to be able to move in translation within the cover. To that end, it could be mounted in slides arranged in the lateral walls of the first part 13 of the cover, these slides guiding it as it moves. The translational movement is therefore guided by these slides and can be substantially longitudinal, or slightly curved in order to follow the curvature of the cover. The above-mentioned translation is therefore not limited to straight-line translation: it could be curved or even circular. As a variant, the lock 9 could have a different arrangement and could be able to move in a different way, such as in rotation. The lock 9 is mounted on the first part.

According to one variant embodiment, the axes of the lock opening 6 of the lock 9 and of the opening 16 of the first part 13 are slightly offset in the closed position of the lock, such that the cooperation between the removable bar 11 and said two openings, in the closed position of the movable lock 9, makes it possible to exert a force on the lock 9 against the first part 13 of the cover and/or against the second assembly member 41 of the cap 13*c*. Thus, the bar 11 clamps the assembly member 51 of the lock 9 to the cover 13, applying tension to the cap 13*c* by means of slight bending of the bar 11, by means of which the cap 13*c* is guaranteed to be held in position, precisely and without play, on the first part 13 of the cover.

Figure 8:
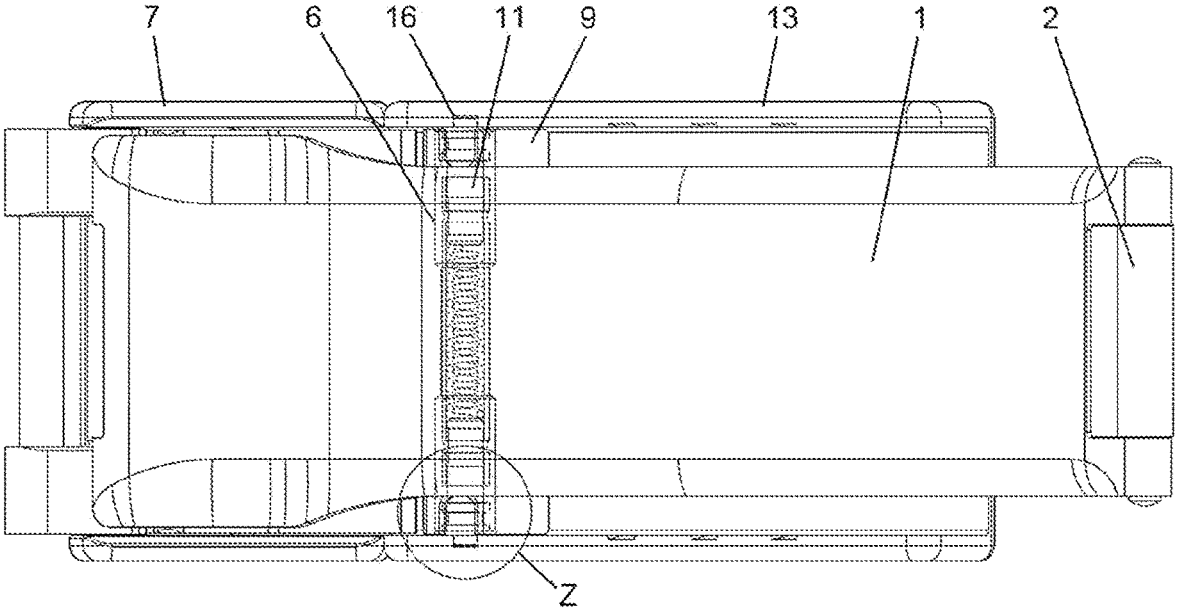
FIG. 8 depicts a top view of the clasp in the closed configuration, comprising a cap in the fastening configuration according to the embodiment of the invention.

FIG. 8 depicts a plan view of the closed clasp in the fastening configuration according to the embodiment of the invention, from the face opposite that which has the cap (lower face). FIGS. 9 and 10 are enlarged views of the region z of this FIG. 8.

It should be noted that, as illustrated in FIG. 10, the bar 11 advantageously comprises bar pivots 11 a that are retracted in the open position of the lock 9 and when the latter is moved, and which are released, as illustrated in FIG. 9, so as to enter the first openings 16 of the first part 13 of the cover in the closed position of the cover. The invention is therefore applicable to any embodiment in which the first part 13 comprises at least one first opening 16.

Figure 7:
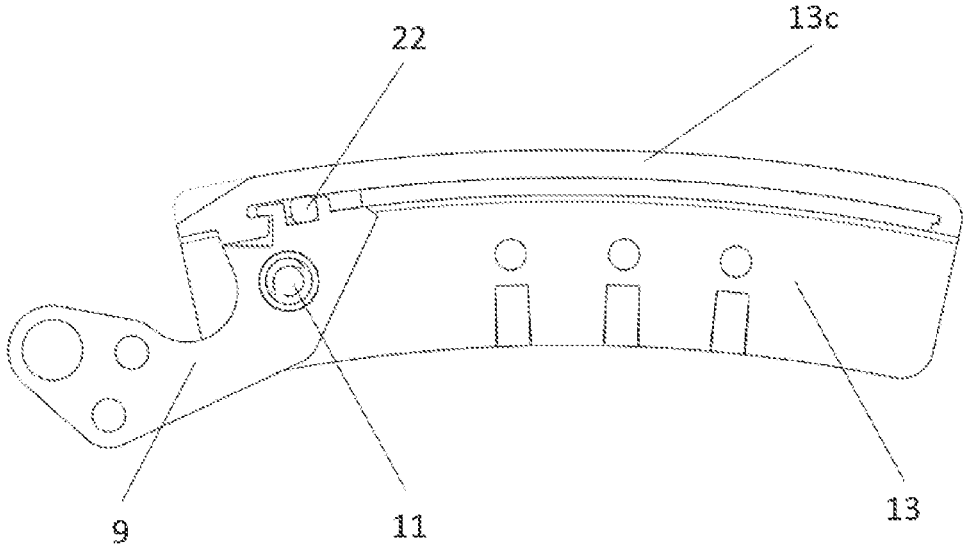
FIG. 7 depicts the same side view in section as that in FIGS. 5 and 6, but with the cover of the clasp comprising a cap in the fastening configuration according to the embodiment of the invention.

Passing from the fastening configuration of FIG. 7 to the free configuration, in which the cap 13*c* can be removed from the cover, is brought about by steps that are the reverse of those described above. Retracting the pivots 11 a of the bar 11 using a tool allows the lock to be moved from its closed position to its open position, and then the cap 13*c* to be removed.

The invention has been described in the context of a cover for a clasp. However, as previously mentioned, the same concept may be implemented on any other timepiece component.

The invention also relates to a timepiece, in particular a wristwatch, comprising at least one timepiece component as previously described.

The invention also relates to a bracelet, this comprising a clasp as previously described. The invention also relates to a wristwatch comprising such a bracelet.

Finally, the invention achieves the desired objectives, and has the following advantages:

- it permits assembly, of a cap on a timepiece component, that is simple and free from any risk of damage;
- it is compatible with the use of a robust cap that is able to withstand external loads such as impacts and scratches;
- it permits reliable fastening of the cap, avoiding unintended disassembly;
- the cap is easily removable, without any risk of damage to the timepiece component, meaning that the cap can be changed if necessary;
- the solution is compatible with the use of a multitude of materials, including those commonly used to achieve an appealing esthetic.

The invention also relates to a method for manufacturing a timepiece component, this comprising a step of fastening a cap 13*c* to a first part 13 of the timepiece component, assembling a first assembly member 40 of the cap 13*c* with a first latching member 50 of the first part 13, then positioning the cap 13*c* in its final position provided in the fastening configuration of the timepiece component, then actuating a movable lock 9 of the first part 13 so as to bring it into a closed position in cooperation with a second assembly member 41 of the cap 13*c*. This method comprises an additional step consisting in locking the closed position of the movable lock 9 on the first part 13 using a bar 11.

The invention claimed is:

1. A timepiece component, comprising:

a first part, and a removable cap, the timepiece component being able to adopt a fastening configuration in which the removable cap is fastened to the first part, and a free configuration in which the cap is separated from the first part, the first part comprising at least a first latching member and a movable lock, and the cap comprising a first assembly member, intended to cooperate with the first latching member of the first part, and a second assembly member, intended to cooperate with the movable lock of the first part, wherein in the fastening configuration of the timepiece component, the first latching member of the first part and the first assembly member of the cap are in engagement, and the movable lock occupies a closed position in which the movable lock is in engagement with the second assembly member of the cap, so that the cap is fastened in a locked manner on the first part, and in the free configuration, the movable lock occupies an open position in which the movable lock releases the second assembly member of the cap, allowing the cap to be separated from the first part, the first part comprises at least one first opening, and the movable lock comprises a lock opening, the at least one first opening and the lock opening being arranged so that they come substantially to face one another when the lock is in the closed position, the timepiece component comprises a retractable bar that is able to cooperate with the at least one first opening and the lock opening when the movable lock is in the closed position, so as to lock the closed position of the movable lock and lock the timepiece component fastening configuration, and so as to be able to release the at least one first opening and lock opening by withdrawing the bar in order to allow the movable lock to move, and pass from the fastening configuration to the free configuration of the timepiece component.

2. The timepiece component as claimed in claim 1, wherein the movable lock is mounted on the first part so as to be able to move in translation, in rotation, or both in translation and in rotation.

3. The timepiece component as claimed in claim 2, wherein axes of the at least one first opening and the lock opening are offset in the closed position of the lock, so that cooperation between the retractable bar and the at least one first opening and the lock opening, in the closed position of the movable lock, makes it possible to exert a force on the movable lock against the first part of the component, against the second assembly member of the cap, or against both the first part of the component and the second assembly member of the cap.

4. The timepiece component as claimed in claim 2, further comprising a play compensating element interposed between the lock and the cap, the play compensating element being made of a material that is flexible, deformable, or both flexible and deformable, the material being designed to be compressed between the cap and the lock when the lock is in the first, closed position, and/or against which the movable lock comes to abut in its first, closed position.

5. The timepiece component as claimed in claim 1, wherein axes of the at least one first opening and the lock opening are offset in the closed position of the lock, so that cooperation between the retractable bar and the at least one first opening and the lock opening, in the closed position of the movable lock, makes it possible to exert a force on the movable lock against the first part of the component, against the second assembly member of the cap, or against both the first part of the component and the second assembly member of the cap.

6. The timepiece component as claimed in claim 5, further comprising a play compensating element interposed between the lock and the cap, the play compensating element being made of a material that is flexible, deformable, or both flexible and deformable, the material being designed to be compressed between the cap and the lock when the lock is in the first, closed position, and/or against which the movable lock comes to abut in its first, closed position.

7. The timepiece component as claimed in claim 1, further comprising a play compensating element interposed between the lock and the cap, the play compensating element being made of a material that is flexible, deformable, or both flexible and deformable, the material being designed to be compressed between the cap and the lock when the lock is in the first, closed position, and/or against which the movable lock comes to abut in its first, closed position.

8. The timepiece component as claimed in claim 1, wherein the cap has a form of a substantially planar and elongate element, the first assembly member and the second assembly member of the cap being arranged at the two opposite distal ends of the cap, on a side of the surface of the cap that is intended to be oriented towards the first part of the timepiece component.

9. The timepiece component as claimed in claim 1, wherein at least one selected from the group consisting of the first latching member of the first part, the movable lock of the first part, the first assembly member of the cap, and the second assembly member of the cap, has a form of a hook, a notch, or both a hook and a notch.

10. The timepiece component as claimed in claim 1, wherein the timepiece is a bracelet clasp cover, and wherein the cap is a substantially planar element that is able to extend over all or part of an upper surface of the cover in the fastening configuration of the timepiece component.

11. The timepiece component as claimed in claim 1, wherein the cap has a form of a one-piece element.

12. The timepiece component as claimed in claim 1, wherein the cap is made of ceramic, cermet, glass, sapphire, mother-of-pearl, amber or natural or reconstituted stone.

13. A timepiece, comprising a timepiece component as claimed in claim 1.

14. A method for manufacturing a timepiece component as claimed in claim 1, comprising:

fastening the cap to the first part of the timepiece component, assembling the first assembly member of the cap with the first latching member of the first part, then positioning the cap in a final position thereof provided in the fastening configuration of the timepiece component, then actuating the movable lock of the first part so as to bring the movable lock of the first part into the closed position in cooperation with the second assembly member of the cap, and locking the closed position of the movable lock on the first part using a bar.

15. The timepiece component as claimed in claim 1, wherein the timepiece is a bracelet clasp cover, and wherein the first part of the bracelet clasp cover comprises a U-shaped cross section formed by an upper surface from which two opposite and substantially mutually parallel lateral surfaces extend perpendicularly to the upper surface, the upper surface having a planar orthogonal projection that is substantially rectangular in shape, the cap being designed to extend over an entire length of the upper surface of the cover and over all or part of the width of the upper surface of the cover.

16. The timepiece component as claimed in claim 15, wherein the first part comprises an upper surface comprising a portion that is set back such that the cap is able to cover the set-back portion of the upper surface in the timepiece component fastening configuration.

17. The timepiece component as claimed in claim 1, wherein the timepiece is a bracelet clasp cover, and wherein the first part comprises an upper surface comprising a portion that is set back such that the cap is able to cover the set-back portion of the upper surface in the timepiece component fastening configuration.

18. A timepiece component, comprising:

a first part, and a removable cap, the timepiece component being able to adopt a fastening configuration in which the removable cap is fastened to the first part, and a free configuration in which the cap is separated from the first part, the first part comprising at least a first latching member and a movable lock, and the cap comprising a first assembly member, intended to cooperate with the first latching member of the first part, and a second assembly member, intended to cooperate with the movable lock of the first part, wherein in the fastening configuration of the timepiece component, the first latching member of the first part and the first assembly member of the cap are in engagement, and the movable lock occupies a closed position in which the movable lock is in engagement with the second assembly member of the cap, so that the cap is fastened in a locked manner on the first part, and in the free configuration, the movable lock occupies an open position in which the movable lock releases the second assembly member of the cap, allowing the cap to be separated from the first part, the cap has a form of a substantially planar and elongate element, the first assembly member and the second assembly member of the cap being arranged at the two opposite distal ends of the cap, on a side of the surface of the cap that is intended to be oriented towards the first part of the timepiece component.

19. The timepiece component as claimed in claim 18, wherein the movable lock is mounted on the first part so as to be able to move in translation, in rotation, or both in translation and in rotation.

20. The timepiece component as claimed in claim 18, further comprising a play compensating element interposed between the lock and the cap, the play compensating element being made of a material that is flexible, deformable, or both flexible and deformable, the material being designed to be compressed between the cap and the lock when the lock is in the first, closed position, and/or against which the movable lock comes to abut in its first, closed position.

21. A timepiece component, comprising:

a first part, and a removable cap, the timepiece component being able to adopt a fastening configuration in which the removable cap is fastened to the first part, and a free configuration in which the cap is separated from the first part, the first part comprising at least a first latching member and a movable lock, and the cap comprising a first assembly member, intended to cooperate with the first latching member of the first part, and a second assembly member, intended to cooperate with the movable lock of the first part, wherein in the fastening configuration of the timepiece component, the first latching member of the first part and the first assembly member of the cap are in engagement, and the movable lock occupies a closed position in which the movable lock is in engagement with the second assembly member of the cap, so that the cap is fastened in a locked manner on the first part, and in the free configuration, the movable lock occupies an open position in which the movable lock releases the second assembly member of the cap, allowing the cap to be separated from the first part, a play compensating element is interposed between the lock and the cap, the play compensating element being made of a material that is flexible, deformable, or both flexible and deformable, the material being designed to be compressed between the cap and the lock when the lock is in the first, closed position, and/or against which the movable lock comes to abut in its first, closed position.

22. The timepiece component as claimed in claim 21, wherein the movable lock is mounted on the first part so as to be able to move in translation, in rotation, or both in translation and in rotation.

23. The timepiece component as claimed in claim 21, wherein at least one selected from the group consisting of the first latching member of the first part, the movable lock of the first part, the first assembly member of the cap, and the second assembly member of the cap, has a form of a hook, a notch, or both a hook and a notch.

* * * * *